US005967689A

United States Patent [19]

Fleischauer

[11] Patent Number: 5,967,689

[45] Date of Patent: Oct. 19, 1999

[54] BINDER FILE

[75] Inventor: Don William Fleischauer, Ronkonkoma, N.Y.

[73] Assignee: The Planhold Corporation, Irvine, Calif.

[21] Appl. No.: 09/006,306

[22] Filed: Jan. 13, 1998

Related U.S. Application Data

[60] Provisional application No. 60/062,749, Oct. 23, 1997.

[51] Int. Cl.[6] ..... B42F 3/04

[52] U.S. Cl. ..... 402/70; 248/317; 248/324; 248/340; 281/47; 281/49; 281/50; 402/5; 402/51; 402/73

[58] Field of Search ..... 281/45–47, 49, 281/50; 402/70, 73, 5, 6, 27, 33, 36, 41–44, 67, 53, 51; 248/317, 324, 340

[56] References Cited

U.S. PATENT DOCUMENTS

| | | |
|---|---|---|
| 60,710 | 1/1867 | Flischl . |
| 132,478 | 10/1872 | Matthias . |
| 199,606 | 1/1878 | Williams . |
| 299,249 | 5/1884 | Nauerth . |
| 306,490 | 10/1884 | Huth . |
| 337,366 | 3/1886 | Borden . |
| 337,678 | 3/1886 | Glaser et al. . |
| 340,305 | 4/1886 | Habitzreiter . |
| 468,795 | 2/1892 | Deming . |
| 479,513 | 7/1892 | Jaehnig . |
| 500,837 | 7/1893 | Albee . |
| 508,769 | 11/1893 | Schweitzer . |
| 525,868 | 9/1894 | Smith . |
| 580,731 | 4/1897 | Scholz . |
| 591,638 | 10/1897 | Rile et al. . |
| 600,541 | 3/1898 | Leopold . |
| 636,166 | 10/1899 | Newbaker . |
| 645,086 | 3/1900 | Green . |
| 699,748 | 5/1902 | Engleking . |
| 751,646 | 2/1904 | Hulquist . |
| 773,728 | 11/1904 | Gardam . |
| 776,853 | 12/1904 | Krabach . |
| 813,752 | 2/1906 | Trussell . |
| 825,714 | 7/1906 | Forster . |
| 842,464 | 1/1907 | Ketzscher . |
| 857,252 | 6/1907 | McMillan . |
| 884,226 | 4/1908 | Sjoberg . |
| 891,844 | 6/1908 | Lieberam . |
| 902,433 | 10/1908 | Muller et al. . |
| 977,454 | 12/1910 | Koecke . |
| 1,005,376 | 10/1911 | Verges . |
| 1,067,214 | 7/1913 | Di Francesca . |
| 1,165,108 | 12/1915 | Memmler . |
| 1,213,757 | 1/1917 | Deckert . |
| 1,227,490 | 5/1917 | Richter . |
| 1,257,611 | 2/1918 | Kelly . |
| 1,270,611 | 6/1918 | Gay . |
| 1,352,398 | 9/1920 | Bartuzel . |
| 1,376,031 | 4/1921 | Orend . |
| 1,412,078 | 4/1922 | Grimes . |
| 1,418,204 | 5/1922 | Ross . |
| 1,423,286 | 7/1922 | Williams . |
| 1,432,652 | 10/1922 | Zakrzewski . |
| 1,515,694 | 11/1924 | Peklenk . |
| 1,695,297 | 12/1928 | Schanchter . |
| 1,820,736 | 8/1931 | Gaylord . |
| 1,842,496 | 1/1932 | Wagner, Jr. . |

(List continued on next page.)

*Primary Examiner*—Andrea L. Pitts
*Assistant Examiner*—Monica Smith
*Attorney, Agent, or Firm*—Schwetzer Cornman Gross & Bondell LLP

[57] ABSTRACT

A binder for storage of sheet materials, particularly large sheet materials, such as maps, blueprints and the like, in a flat configuration. An elongated frame element, which supports the sheet materials along a marginal edge in a hanging orientation, is provided with a pivoting hand grip mounted on the frame and movable between vertical and horizontal orientations. The hand grip, of which there may be more than one, enables the binder and its contents to be conveniently removed from a storage rack and re-positioned for use.

5 Claims, 2 Drawing Sheets

U.S. PATENT DOCUMENTS

| | | | |
|---|---|---|---|
| 1,909,519 | 5/1933 | Braunstein . | |
| 1,909,675 | 5/1933 | Heller . | |
| 1,911,277 | 5/1933 | Helmer . | |
| 2,061,434 | 11/1936 | Murray . | |
| 2,395,618 | 2/1946 | Elvers . | |
| 2,683,478 | 7/1954 | Seelig . | |
| 2,869,210 | 1/1959 | Schneider . | |
| 3,617,074 | 11/1971 | Rigolini | 281/49 |
| 4,180,341 | 12/1979 | Langhorst | 281/45 X |
| 4,398,752 | 8/1983 | Hwang Lii | 281/47 |
| 4,444,418 | 4/1984 | Goldstein | 281/45 |
| 4,449,270 | 5/1984 | Brabant | 281/47 X |
| 4,493,495 | 1/1985 | Linn | 281/45 |
| 4,524,992 | 6/1985 | Linn | 281/45 |
| 4,557,503 | 12/1985 | Linn | 281/49 |
| 4,949,997 | 8/1990 | Champagne | 281/45 |
| 5,636,869 | 6/1997 | Holmes . | |

42
40
62
40
10
24
48
3
50
48
2
24
46
44
12
3
2
14

50
10
24
38
36
30
26
20
34
34
28
22
32
32
12
18
16
14

BINDER FILE

This Application claims benefit of provisional application 60/062,749, filed Oct. 23, 1997.

The present invention relates to a new and improved hanging-type binder of the type utilized for the storage of sheet-like material in a flat condition.

BACKGROUND OF THE INVENTION

Blueprints, maps and similar large documents may be stored in binders which releasably hold one or more of the sheets along a marginal edge, allowing the bound sheets to be folded back for observation of underlying sheets without removing the sheets from the binder. The binders are stored upon a rack, with the sheets hanging from the binders within the rack.

Typical construction for such binders does not provide for any hand support or gripping means other than the binder itself. While a binder can generally be removed from a rack by the mere grasping of the binder itself, subsequent positioning of the binder, such as placing the binder on an easel, table, or the like may require twisting and turning of the binder, resulting in awkward positioning of the hands and wrists, and placing undue strain thereon. In addition, sharp edges and corners of the binder are capable of inflicting injury if sufficient care is not exerted. While the binders themselves may be of relatively light-weight construction, the addition of a substantial set of large documents can materially add to the binder's weight, making movement and carriage more cumbersome.

It is accordingly the purpose of the present invention to provide a binder having improved handgrips to facilitate removal of the binder from a storage rack and further transport and positioning thereof. In accordance with such and further objects and purposes, the binder of the present invention includes a pistol grip-type handle mounted in a vertical orientation upon an end of the binder. The grip may be pivotable from a vertical to a horizontal position. One or more handles are also provided along the top of the binder. The handles are exposed for access and use as the binder is removed from the rack, permitting the user to obtain an alternative, secondary grip on the binder to facilitate complete removal of the binder from the rack and subsequent positioning of the binder as required.

BRIEF DESCRIPTION OF THE DRAWINGS

A fuller understanding of the present invention will be accomplished upon review of the following detailed description of a preferred, but nonetheless illustrative embodiment of the invention, when reviewed in conjunction with the annexed drawings, wherein.

DETAILED DESCRIPTION OF THE INVENTION

Figures 1, 5:
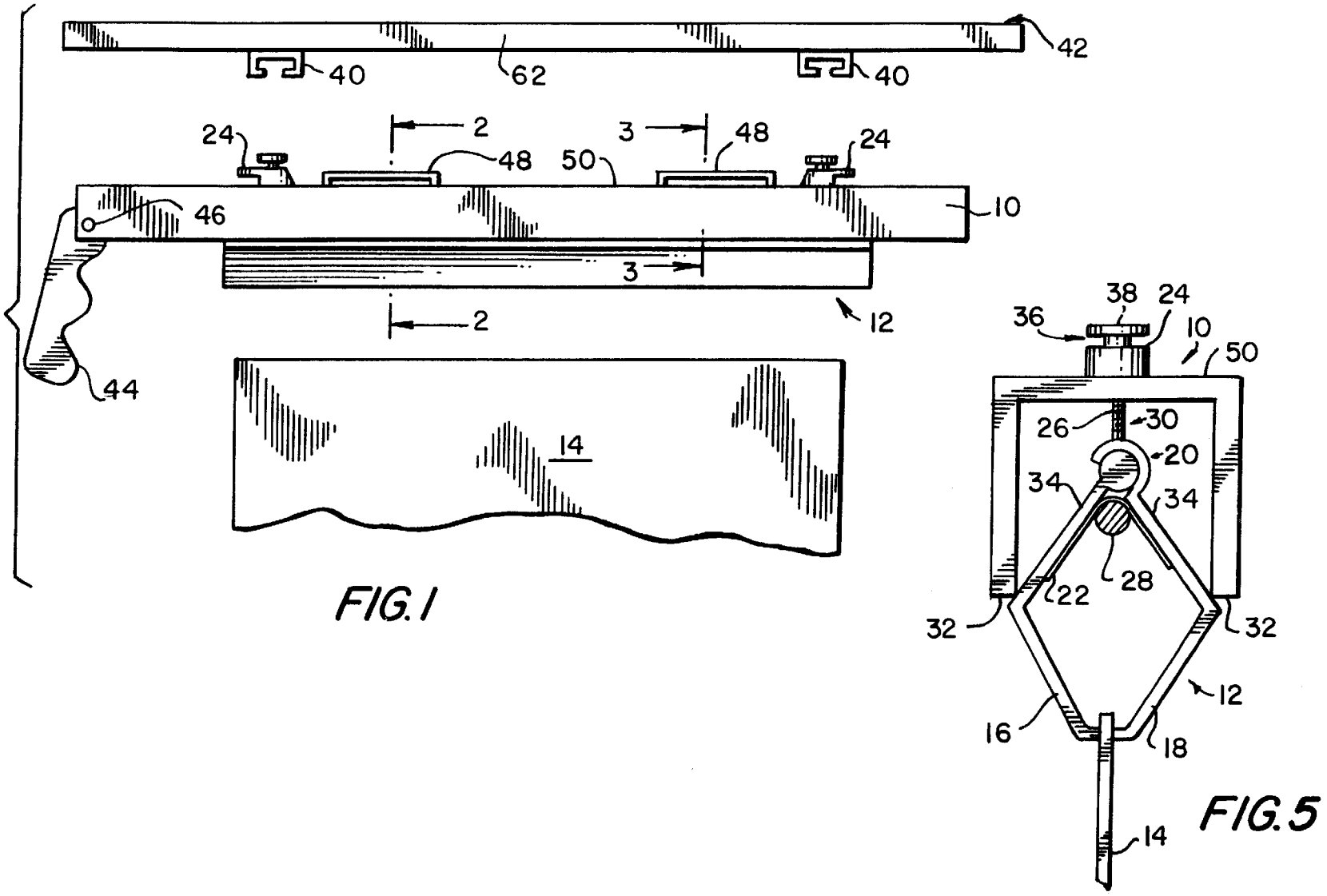
FIG. 1 is a side elevation view of a binder embodying the present invention.
FIG. 5 is an enlarged sectional view taken along line 5—5 of FIG. 1, detailing the clamp assembly of the binder.
Figure 2:
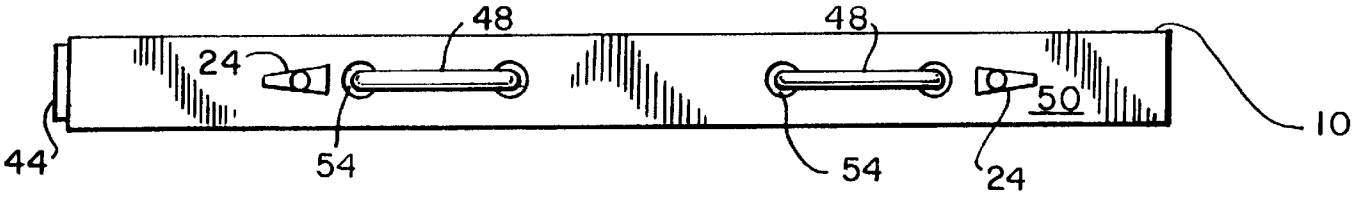
FIG. 2 is a top plan view thereof.

As depicted in the figures, a binder constructed in accordance with the present invention comprises an elongated binder frame 10, which may be, for example, in the form of a U-channel of aluminum or other like material. The length of the frame may be upwards of two to three feet, to support sheets having a similar lateral dimension. A pair of elongated jaws 12 project from the frame for gripping and retaining sheet materials 14 along a marginal edge. The jaws may be of a hinged construction, as detailed in FIG. 5, the individual jaws 16 and 18 being joined by a hinge construction 20 and biased apart by leaf spring 22. A pair of internally-threaded tension knobs 24 engage drawbolts 30 having threaded stems 26, which pass through the hinge, and heads 28. Clockwise rotation of the knobs 24 draws the drawbolt upward, causing the jaws 16, 18 to be retracted upwardly into the U-channel frame 10. The contact between the edges 32 of the frame and the diverging portions 34 of the jaws drive the jaws together, gripping the sheets 14. Counter-clockwise rotation of the knobs lowers the drawbolts, along the jaws to open responsive to the action of the spring 22.

The tension knobs 24 may be provided with an integral reduced diameter neck 36 and a head 38 to allow the binder to be mounted in channel members 40 of a rack assembly 42, the heads 38 being supported within the channel members, the binders hanging therefrom.

A pistol grip handle 44 is mounted to an end of the binder, a portion of the U-channel frame 10 extending past the jaws forming a yoke therefor. The handle is mounted to the yoke by transverse pivot rod 46. Pistol grip handle 44, which is contoured and dimensioned to provide a comfortable grip for the hand, can thus be pivoted as depicted in the figures between a depending, vertical orientation and an upwardly-pivoted horizontal orientation to provide a comfortable, variable grip for the user. The pistol grip handle 44 may be formed of any appropriate material as known in the art, such as a molded high-impact plastic.

In addition, or as an alternative, one or more top-mounted, recessed handles 48 are provided. The handles extend upwardly from the top wall 50 of the binder frame 10 and provide a convenient supplemental gripping means for the binder for removal from a rack assembly and subsequent positioning. As detailed in FIGS. 3 and 4, the vertical legs 52 of the handle extend through bores 54 in the top wall 50. The handles are normally in the lowered position, the horizontal hand grip portion 56 extending slightly above the upper surface of the top wall due to the interference between the transition portions 60 of the handles with the edge of the bores 54, with the handle legs 52 being retained within the interior of the frame 10.

Figure 3:
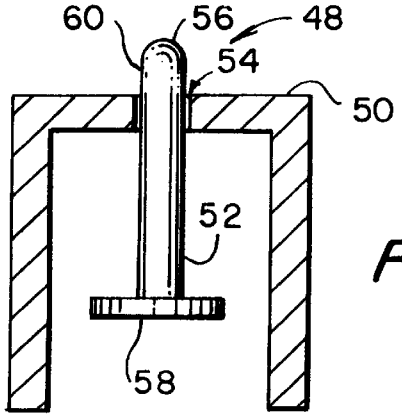
FIG. 3 is an enlarged sectional view taken along line 3—3 of FIG. 1.
Figure 4:
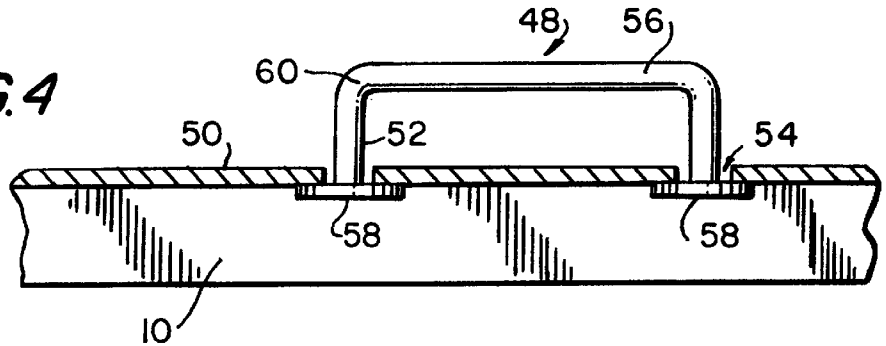
FIG. 4 is an enlarged sectional view taken along line 4—4 of FIG. 1.

A pair of stops 58 are affixed to the lower ends of the handle legs 52 and are sized to prevent removal of the handles from the mounting bores 54. Accordingly, and as depicted in FIG. 4, when a handle is gripped and raised to support the binder, the handle assumes the position as shown, the stops 58 supporting the handle against the binder by contact with the lower surface of the top wall 50. When the user's grip is released, the handle drops to the lowered position as depicted in FIG. 3. Typically, the clearance between the binder and any rack components, such as channel support 62 of rack 42, will be sufficient to accommodate the small protrusion of the handle 48 above the top wall when in the lowered position. Indeed, the typical protrusion will be less than that of the knobs 24. Alternatively, however, the binder top wall 50 may be provided with depressed areas surrounding the handle locations and upon which the handles rest in the lowered position to further minimize the projection of the handles above the top wall.

The combination of the trigger handle 44 and one or more top wall handles 48 provide for a variety of grip positions, increasing the comfort and manageability of binders and the support materials, particularly when they are to be removed from racks and positioned in a variety of orientations.

I claim:

1. A binder for storage of sheet materials in a flat configuration, comprising an elongated frame having a U-shaped member; means for supporting sheet materials along a marginal edge in a hanging orientation from said frame; and a pivoting handgrip mounted upon a pin extending between opposed side walls of the U-shaped member at an end of said frame, the handgrip being pivotable between vertical and horizontal orientations.

2. A binder for storage of sheet materials in a flat configuration, comprising an elongated frame, means for supporting sheet materials along a marginal edge in a hanging orientation from said frame; a pivoting handgrip mounted to an end of said frame, pivotable between vertical and horizontal orientations; and an extendable handle movably mounted to a top wall of said frame, said extendable handle having retracted and extended positions and having a handgrip portion being in close proximity to said top wall to provide minimal increase in the vertical height of said binder when said handle is in the retracted position.

3. The binder of claim 2, wherein said extendable handle further includes a pair of downwardly-extending legs at opposed ends of said handgrip portion, said frame top wall having a pair of spaced bores dimensioned to accept said legs, said legs extending through said bores, each leg having a stop mounted to a distal end thereof to prevent the removal of said legs from said bores when said handle is in the extended position.

4. The handle of claim 1 further comprising binder mounting means extending upwardly from said binder top wall, said handgrip portion of said extendable handle being dimensioned whereby it extends upwardly from said top wall when in the retracted position a height lesser than the height of said binder mounting means.

5. The binder of claim 2, wherein said frame comprises a U-shaped member, said pivoting handgrip being mounted upon a pin extending between opposed side walls of said U-shaped member.

* * * * *